US006639345B2

(12) United States Patent
Inoue et al.

(10) Patent No.: US 6,639,345 B2
(45) Date of Patent: Oct. 28, 2003

(54) COLOR CATHODE RAY TUBE

(75) Inventors: Yuichi Inoue, Mobara (JP); Katsuyuki Kawamura, Mobara (JP)

(73) Assignee: Hitachi, Ltd., Tokyo (JP)

( * ) Notice: Subject to any disclaimer, the term of this patent is extended or adjusted under 35 U.S.C. 154(b) by 27 days.

(21) Appl. No.: 09/800,677

(22) Filed: Mar. 7, 2001

(65) Prior Publication Data

US 2001/0020817 A1 Sep. 13, 2001

(30) Foreign Application Priority Data

Mar. 13, 2000 (JP) ..... 2000-068376

(51) Int. Cl.[7] ..... H01J 29/10; H01J 29/80

(52) U.S. Cl. ..... 313/461; 313/402; 313/403; 313/404

(58) Field of Search ..... 313/402–404, 313/397, 406–408, 461

(56) References Cited

U.S. PATENT DOCUMENTS

| | | | | |
|---|---|---|---|---|
| 6,124,668 A | * | 9/2000 | Shoda | 313/403 |
| 6,133,686 A | * | 10/2000 | Inoue et al. | 220/2.1 A |
| 2001/0008360 A1 | * | 7/2001 | Tsuji | 313/402 |

FOREIGN PATENT DOCUMENTS

| | | |
|---|---|---|
| JP | 57-090850 | 6/1982 |
| JP | 57-136739 | 8/1982 |
| JP | 58-147941 | 9/1983 |
| JP | 2000-030624 | 9/1983 |
| JP | 59-194330 | 11/1984 |
| JP | 03-067440 | 3/1991 |
| JP | 08-017357 | 1/1996 |
| JP | 09-180644 | 7/1997 |
| JP | 10-233173 | 9/1998 |
| JP | 11-016511 | 1/1999 |

* cited by examiner

*Primary Examiner*—Sandra O'Shea
*Assistant Examiner*—Peter Macchiarolo
(74) *Attorney, Agent, or Firm*—Milbank, Tweed, Hadley & McCloy, LLP

(57) ABSTRACT

To realize a high-quality flat-face type of color cathode ray tube by combining a tint panel with a pressed mask, the outer surface of the panel of the color cathode ray tube is made nearly flat and the inner surface of the panel is curved in a concave shape, and the long-length direction pitch of slots formed in an aperture region 2 of a pressed mask 1 to be disposed close to the inner surface and the connection-direction width of each of bridges which connect the slots are made different between a central portion (A) and a peripheral portion (B) in the apertured region 2 of the pressed mask 1, whereby the ratio of bridges per unit area is made larger in the central portion (A) than in the peripheral portion (B) or the opening rate of slots per unit area is made larger in the peripheral portion (B) than in the central portion (A). According to this construction, the mechanical strength of the central portion (A) of the pressed mask becomes large, whereby it is possible to restrain the occurrence of undesired deformation of the pressed mask 1 due to the increase of the radius of curvature of the central portion (A) and it is possible to uniformize brightness over the entire screen.

20 Claims, 7 Drawing Sheets

COLOR CATHODE RAY TUBE

BACKGROUND OF THE INVENTION

The present invention relates to a color cathode ray tube, and more particularly to a color cathode ray tube provided with a shadow mask corresponding to a large-screen flat face.

Color cathode ray tubes which are widely adopted as display devices for information terminals and television sets have a tendency for their screen sizes to become large. In addition, a so-called flat-face type in which a panel portion which forms a screen is flattened has been becoming popular.

The current popular type of color cathode ray tube is constructed in such a manner that a color selection electrode is installed close to the inner surface of a panel on which phosphor picture elements for three colors are formed, and three electron beams emitted from an electron gun are made to individually impinge on the respective phosphor picture elements by means of the color selection electrode.

Such a color selection electrode uses a so-called pressed mask having a structure in which a thin plate member in which multiple holes (electron beam apertures) such as round holes (dot-like holes) or elongated holes (slots) are formed is press-formed into a curved shape which follows the curvature of an inner surface of a panel portion, or a tension mask having a structure in which a thin plate member in which multiple holes are formed is tensely mounted on a frame-like member (frame), or a so-called aperture grill having a structure in which multiple strings arranged in the form of a reed screen are tensely passed between opposite sides of a frame-like member. Incidentally, the pressed mask and the tension mask in particular are also called shadow mask.

This kind of color cathode ray tube has an evacuated envelope which is integrally formed of a panel constituting a phosphor screen, a neck accommodating an electron gun, and a funnel-like funnel connecting the panel and the neck.

Incidentally, an art associated with the structure of an apertured region where the electron beam apertures of the shadow mask are disposed is described in, for example, Japanese Patent Laid-Open No. 82234/1996.

SUMMARY OF THE INVENTION

The panel portion of the flat-face type of color cathode ray tube has nearly flat inner and outer surfaces and has a glass plate thickness which is made large compared to the panel portion of a round-face type of color cathode ray tube in order to ensure mechanical strength such as implosion resistance. In general, the above-described tension mask is used as a shadow mask to be installed in this flat-face type of cathode ray tube.

The panel portion of another flat-face type of color cathode ray tube has a nearly flat outer surface and has an inner surface which is curved in a concave shape toward the outer surface so that its glass plate thickness is made larger in its peripheral portion than in its central portion. A pressed mask, which is press-formed in a shape approximately following the curvature of the inner surface of the panel portion, is widely used as a shadow mask to be installed in this flat-face type of cathode ray tube.

As a panel which constitutes the evacuated envelope of a color cathode ray tube, a panel (tint panel) which uses a tint material suited to high-contrast picture display is widely used. At present, this tint panel is the main current in the market of panels for cathode ray tubes, and is comparatively inexpensive in terms of cost and can be easily obtained. In addition, the tint panel is superior in the contrast of pictures in cathode ray tubes because the tint panel is low in optical transmissivity compared to a panel using a clear material or a gray material (a clear panel or a gray panel).

On the other hand, in the case of a panel in which the radius of curvature is made extremely larger on the outer surface than on the inner surface and the outer surface is made nearly flat, the thickness of the panel is considerably larger in its peripheral portion than in its central portion, and the optical transmissivity (optical transmission amount) of the peripheral portion is considerably lower than that of the central portion. If a tint panel which is low in optical transmissivity as a whole is applied to the above-described panel which is made nearly flat, a lowering of the optical transmissivity of the peripheral portion stands out, and the uniformity of luminance over the entire region of the screen of the cathode ray tube is impaired.

Accordingly, if the emission amount of phosphors is the same over the entire region of the panel, i.e., if an electron beam amount to be transmitted through a color selection electrode is the same over the entire region, the brightness of the peripheral portion lowers. This difference in optical transmissivity can be corrected by changing the electron beam amount to be transmitted through the color selection electrode.

In addition, in the flat-face type of color cathode ray tube in which the inner and outer surfaces are made nearly flat, particularly in the flat-face type whose screen size is large, a tension mask or an aperture grill is suitable in which deformation due to thermal expansion at the time of collision of electron beams with the color selection electrode does not easily occur.

However, the tension mask and the aperture grill, when color selection electrodes are to be tensely mounted on their frames, require a process for imparting an optimum tension taking account of a relaxation amount or the like due to material strength and temperature variation, and need structures which are mechanically rigid as the frames. Therefore, the manufacturing costs of the tension mask and the aperture grill are large.

In contrast, since the pressed mask is manufactured by being press-formed into a shape approximately following the curvature of the inner surface of the panel, the manufacture of the pressed mask per se is easy. However, on the other hand, as the panel size is larger, for example, as the diagonal length of the effective screen region of the panel becomes larger, to 76 cm or more, the curvature of the central portion of the inner panel surface becomes smaller (the radius of curvature becomes larger). In the case where this pressed mask is applied to a panel whose outer surface is made nearly flat, the difference in plate thickness between the central portion and the peripheral portion needs to be made as small as possible in order to improve the uniformity of luminance over the entire region of the screen of the cathode ray tube. Specifically, the extent of curvature of each of the inner surface and the pressed mask needs to be made as small as possible, and the radius of curvature of each of the inner surface and the pressed mask needs to be made a predetermined value or more. In general, in the case of the pressed mask which is formed of a thin plate, as the extent of curvature of the pressed mask becomes larger, its shape holding ability becomes larger, whereas as the extent of curvature becomes smaller, its mechanical strength becomes lower and the shape holding ability becomes smaller.

In particular, if the pressed mask is used in the above-described flat-face type of color cathode ray tube having a very large screen size, the pressed-mask strength of the central portion in which the radius of curvature is large becomes small and the mechanical strength (curved-surface-shape holding ability) easily becomes low, so that shape deformation occurs due to external shock during a manufacturing process or during transportation or due to heating during operation and causes a great lowering of color reproducibility, and a lowering of picture quality is liable to occur.

The curvature of this kind of pressed mask is made small in the center portion and large in the peripheral portion, and the pressed mask is fixed to the frame-like member by being bent along its outermost skirt portion in a direction parallel to the tube axis of the color cathode ray tube.

The zone of the above-described central portion exists in a width of approximately ⅓ to ⅔ in the center of the apertured region in the long-axis direction thereof which region is a region containing a portion where the radius of curvature of the pressed mask is the largest. For this reason, the peripheral portion can acquire the mechanical strength required to hold its shape, but in the central portion, it is difficult to obtain sufficient mechanical strength.

From these facts, if the pressed mask is used in the flat-face type of color cathode ray tube having the tint panel, there occurs the problem that it is necessary to ensure the mechanical strength of the central portion.

The invention solves such problem and realizes a high-quality flat-face type of color cathode ray tube by combining a tint panel with a pressed mask. In particular, the invention solves the problems peculiar to the pressed mask in a large-sized or very-large-sized flat-face type of color cathode ray tube using a tint panel, thereby obtaining a shadow mask whose deformation resistant strength is large.

To this end, in a typical constitution of the invention, the outer surface of the panel of the color cathode ray tube is made approximately flat and the inner surface of the panel is curved to become concave toward the outer surface, and at least one of the long-length direction pitch of slots formed in a pressed mask to be disposed close to the inner surface and the connection-direction width of each of bridges which connect the slots in the long-length direction is made different between the central portion and the peripheral portion of the apertured area of the pressed mask, whereby the ratio of bridges per unit area is made larger in the central portion than in the peripheral portion or the opening rate of slots per unit area is made larger in the peripheral portion than in the central portion.

In general, if the radius of curvature of the central portion of the pressed mask is made large, the space between the inner panel surface and the central portion varies due to a so-called doming phenomenon due to the application of external shock or temperature rise, and undesired deformation of the pressed mask occurs.

However, according to the typical constitution of the invention, the mechanical strength of the central portion of the pressed mask is made large, whereby it is possible to restrain the occurrence of the undesired deformation of the pressed mask. In addition, it is possible to uniformize brightness over the entire screen.

The central portion can be defined as a zone having an approximately ⅓ to ⅔ width in the center of the panel in the long-axis direction thereof, or a zone having an approximately ⅓ to ⅔ width in the center of the panel in the short-axis direction thereof, or a combination of these zones.

Moreover, slots can be provided between the central portion and the peripheral portion at a long-length-direction pitch which is an intermediate value between those of the slots in the central and peripheral portions, and an intermediate portion (transitional portion) having the connection-direction space width of each of bridges which connect these bridges can be provided. In addition, in at least one of the central portion and the peripheral portion, the slot pitch and the bridge width can also be gradually varied in a direction away from the center of the apertured region. With this constitution, sharp variations in the slot pitch and the bridge width are restrained, whereby mechanical strength can be smoothly varied from the peripheral portion to the central portion.

Accordingly, even in the case of a very-large-sized flat-face type of color cathode ray tube in which the diagonal size of the effective display region exceeds 76 cm, a tint panel and a pressed mask can be combined and a low-cost and high-quality color cathode ray tube can be realized.

Incidentally, the invention is not limited to a flat-face type of color cathode ray tube having a large screen size or a very large screen size, and can also be similarly applied to a flat-face type of color cathode ray tube having a comparatively small screen size, in the case where a very thin plate is used as its pressed mask.

DESCRIPTION OF THE PREFERRED EMBODIMENTS

Embodiments of the invention will be described below in detail with reference to the drawings of the embodiments.

Figure 1:
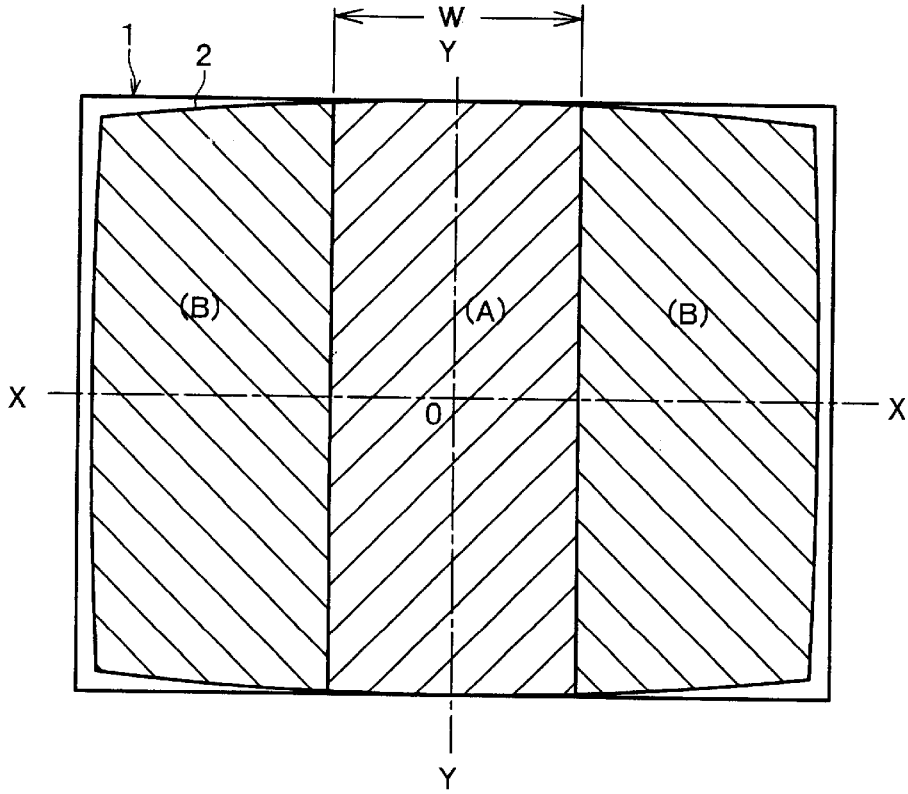
FIG. 1 is a plan view of a pressed mask illustrating a first embodiment of the color cathode ray tube according to the invention.

FIG. 1 is a plan view of a pressed mask illustrating a first embodiment of the color cathode ray tube according to the invention, and schematically illustrates a region where are arranged a central portion and a peripheral portion of the pressed mask which is disposed close to the inner panel surface of the color cathode ray tube.

Figure 2A:
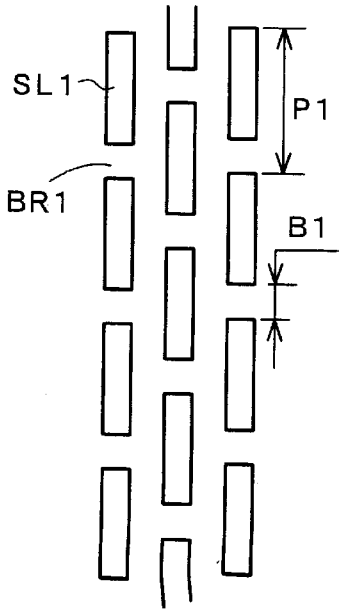
FIGS. 2A and 2B are plan views of essential portions, schematically illustrating slots and bridges formed in central and peripheral portions.
Figure 2B:
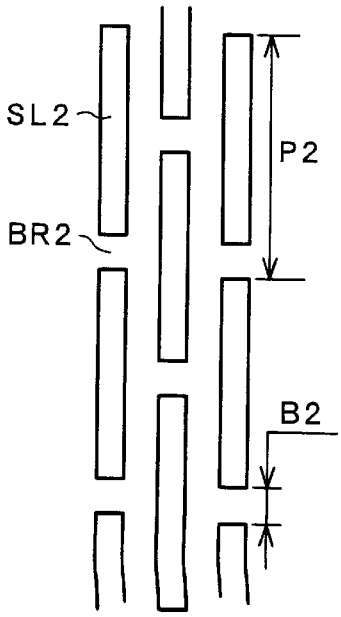

FIGS. 2A and 2B are plan views of essential portions, schematically illustrating slots formed in the central and peripheral portions shown in FIG. 1 as well as bridges which connect the slots in the long-length direction thereof.

Referring to FIG. 1, the pressed mask 1 has an approximately rectangular shape having long sides along the horizontal direction (the direction parallel to the X—X axis (long axis) of FIG. 1) and short sides along the vertical direction (the direction parallel to the Y—Y axis (short axis) of FIG. 1), and has an apertured region 2 which forms a display region in its inside. A zone which has an approximately ⅓ width W in the horizontal center of the apertured region 2 is made a central portion (A), and the right and left sides of the central portion (A) are made the peripheral portion (B). The zone of approximately ⅓ width which is made the central portion (A) is a region which contains a portion where the radius of curvature of the pressed mask is the largest.

FIG. 2A shows the long-length-direction pitch of slots and the connection-direction width of each of bridges in the vicinity of a central point O (the intersection of the X—X axis and the Y—Y axis) of the central portion (A) of FIG. 1, while FIG. 2B shows the long-length-direction pitch of slots and the connection-direction width of each of bridges at an arbitrary point in the periphery (B) of FIG. 2B. Slots SL1 and SL2 which are respectively formed in the central portion (A) and the peripheral portion (B) have long-length directions in a direction parallel to the short axis (the Y—Y axis) of the pressed mask 1, and are disposed to be respectively connected by the bridges BR1 and BR2 in the long-length directions. Incidentally, each bridge that connects slots in the long-length direction is formed of the region between the slots arranged in a slot row extending in the vertical direction (the direction parallel to the Y—Y axis (short axis)) in the apertured region of the pressed mask. That is to say, the bridge is the region between the slots in a width in the short-length direction of the slots (in the direction perpendicular to the long-length direction).

Letting P1 be the connection-direction pitch of the slots SL1 in the vicinity of the central point O of the central portion (A), letting P2 be the connection-direction pitch of the slots SL2 at an arbitrary point in the peripheral portion (B), letting B1 be the connected-slot space width of each of the bridges BR1 which connect the slots SL1 in the vicinity of the central point O of the central portion (A), and letting B2 be the connected-slot space width of each of the bridges BR2 which connect the slots SL2 at an arbitrary point in the peripheral portion (B), p1<P2 and B1=B2. Incidentally, the long-length arrangement pitch (the above-described connection-direction pitch) of the slots is equivalent to the sum of the long-length-direction opening size of each of the slots and the connected-slot space width of each of the bridges.

According to the constitution of this embodiment, the area of bridges per unit area in the central portion (A) becomes larger than that in the peripheral portion (B). Therefore, the mechanical strength of the central portion (A) of the pressed mask can be made large, and even if the radius of curvature becomes large, the curved shape of the pressed mask can be retained.

Accordingly, the undesired deformation of the pressed mask due to the application of external shock or temperature rise is restrained, and even if the pressed mask is combined with a flat-face type of panel, the color cathode ray tube can perform a stable color selection function, whereby the occurrence of color deviation and color irregularity of the color cathode ray tube can be restrained. Moreover, the opening rate of the slots SL2 in the peripheral portion (B) becomes higher than that in the central portion (A), whereby the brightness of the peripheral portion (B) can be improved. In the case where a tint panel suited to high contrast picture display is employed, the low optical transmissivity of its peripheral portion is corrected to enable a high-luminance picture to be displayed on the entire screen, whereby it is possible to provide a color cathode ray tube capable of displaying a high-quality picture.

In this embodiment, the central portion (A) is defined as the zone having the approximately ⅓ width in the horizontal center of the apertured region 2 which is the region containing the portion where the radius of curvature of the pressed mask is the largest. However, even if the zone of the central portion (A) is defined as an approximately ⅔ width in the horizontal center of the apertured region 2 which width corresponds to a region which contains the approximately ⅓ width and has a comparatively large radius of curvature, similar advantages can be achieved.

Specific numerical examples of this embodiment are as follows. In the case where the external dimensions of the pressed mask 1 using an iron-containing material having a plate thickness of 0.25 mm are about 735 mm in length along the long axis, 562 mm in length along the short axis, and about 870 mm in diagonal length, the connection-direction pitch P1 of the slots SL1 in the vicinity of the central point O of the central portion (A) is 84±0.005 mm, the connection-direction pitch P2 of the slots SL2 in the vicinity of each corner of the peripheral portion (B) is 1.40±0.005 mm, the connected-slot space width B1 of each of the bridges BR1 which connect the slots SL1 in the vicinity of the central point O of the central portion (A) is 0.1500±0.005 mm, and the connected-slot space width B2 of each of the bridges BR2 in the vicinity of each corner of the peripheral portion (B) is 0.1500±0.005 mm. Incidentally, the connection-direction pitch of the above-described slots is a numerical example for a shadow mask used in a color cathode ray tube for a general-purpose television set. For example, in a shadow mask used in a color cathode ray tube for a television set for high-definition digital broadcasting, the connection-direction pitch P1 of the slots SL1 in the central portion (A) is made 0.60±0.005 mm and the connection-direction pitch P2 of the slots SL2 in the peripheral portion (B) is made 0.84±0.005 mm, whereby the display density of a picture is enhanced.

The P2/P1 ratio of the connection-direction pitch of the slots in the central portion (A) to the connection-direction pitch of the slots in the peripheral portion (B) is preferably 1.05 to 1.85. If the connected-slot space width of the bridges in the central portion (A) is the same as the connected-slot space width of the bridges in the peripheral portion (B) and P2/P1 is lower than 1.05, the effect of luminance improvement in the peripheral screen portion of a flat-face type cathode ray tube is small. On the other hand if P2/P1 exceeds 1.85, the vertical resolution of a display picture in the peripheral screen portion of such cathode ray tube is degraded.

In addition, in the above-described numerical examples, each of the central portion (A) and the peripheral portion (B) is assigned one kind (two kinds in total) of connection-direction pitch of the slots, but similar advantages can be achieved even if the above-described P2/P1 is gradually increased from the central point O in at least one direction toward a short-axis end, a long-axis end or a corner within the range where the P2/P1 does not exceed 1.85. Particularly in a wide-screen color cathode ray tube having an aspect ratio of 16:9 or the like, if the above-described P2/P1 is gradually increased at least from the central point O toward a long-axis end or a corner at which the deflection angle is large, the luminance uniformity in the entire region of the screen is effectively improved. In addition, even if the P2/P1 of the connection-direction pitch of the slots is gradually increased as described above in only the peripheral portion (B), similar advantages can be achieved.

Figure 3A:
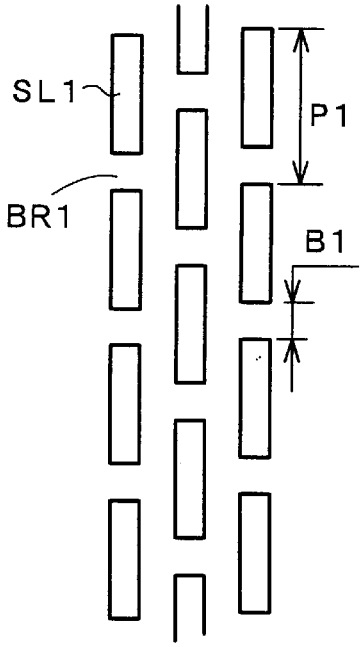
FIGS. 3A and 3B are plan views of essential portions similar to FIGS. 2A and 2B, illustrating a second embodiment of the color cathode ray tube according to the invention.
Figure 3B:
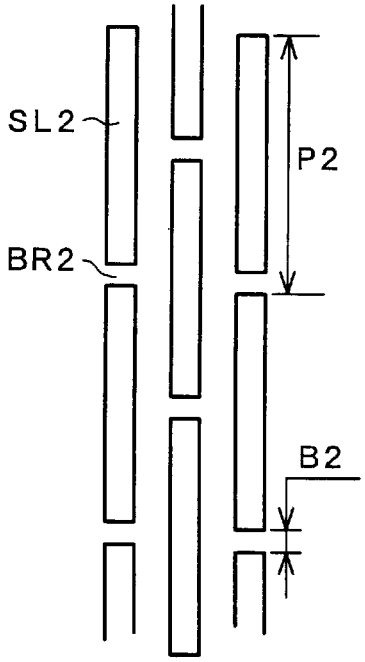

FIGS. 3A and 3B are plan views of essential portions similar to FIGS. 2A and 2B, illustrating a second embodiment of the color cathode ray tube according to the invention. In this embodiment, the relationships among the connection-direction pitch P1 of the slots SL1 in the central portion (A), the connection-direction pitch P2 of the slots SL2 in the peripheral portion (B), the connected-slot space width B1 of each of the bridges BR1 which connect the slots SL1 in the central portion (A) and the connected-slot space width B2 of each of the bridges BR2 which connect the slots SL2 in the peripheral portion (B) are set to P1<P2 and B1>B2.

According to the constitution of this embodiment, as compared with the first embodiment, the area of the bridges BR1 per unit area in the central portion (A) is far larger than the area of the bridges BR1 per unit area in the peripheral portion (B). Accordingly, the mechanical strength of the central portion (A) of the pressed mask can be made far larger, and even if the radius of curvature becomes large, the curved shape can be fully retained.

Accordingly, similarly to the case of the first embodiment, the undesired deformation of the pressed mask is restrained, whereby the color deviation and the color irregularity of the color cathode ray tube can be restrained. In addition, as compared with the case of the first embodiment, the opening rate of the slots SL2 in the peripheral portion (B) is far higher than the opening rate of the slots SL2 in the central portion (A), whereby the brightness of the peripheral portion (B) can be improved to a further extent. Even if a tint panel having a low optical transmissivity is used, the low optical transmissivity of its peripheral portion is efficiently corrected to enable a high-luminance picture to be displayed on the entire screen, whereby it is possible to provide a color cathode ray tube capable of displaying a high-quality picture. In addition, in the second embodiment, since the luminance of the peripheral panel portion of the color cathode ray tube is effectively improved, a panel (dark tint panel) which uses a dark tint material having a far lower optical transmissivity than the tint panel can be applied. Accordingly, it is possible to provide a color cathode ray tube capable of displaying a picture of far higher contrast.

In this embodiment as well, similarly to the case of the first embodiment, even if the zone of the central portion (A) is enlarged to an approximately ⅔ width in the horizontal center of the apertured region 2, similar advantages can be achieved.

Specific numerical examples of this embodiment are as follows. The connected-slot space width B1 of each of the bridges BR1 which connect the slots SL1 at the central point O of the pressed mask 1 (at or near the intersection of the X—X axis and the Y—Y axis) is 0.1500 mm, and the connected-slot space widths B2 of the bridges BR2 which connect the slots SL2 are 0.1379 mm and 0.1412 mm, respectively, in the vicinity of each corner of the pressed mask 1 and in the vicinity of each end of the long axis of the pressed mask 1. In addition, the connected-slot space widths B1 and B2 of the bridges BR1 and BR2 are gradually decreased, respectively, from the central point O toward each end of the long axis and from the central point O toward each corner. The other numerical examples are the same as those of the first embodiment.

Figure 4A:
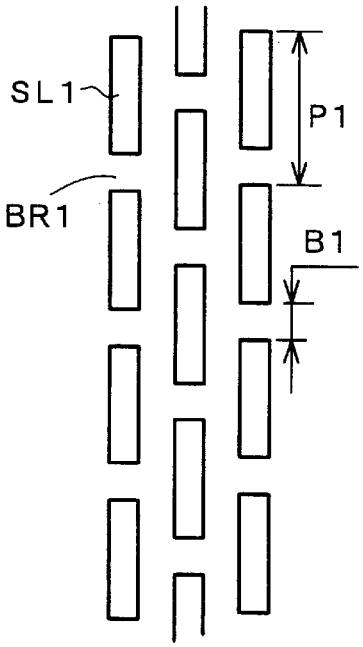
FIGS. 4A and 4B are plan views of essential portions similar to FIGS. 2A and 2B and 3A and 3B, illustrating a third embodiment of the color cathode ray tube according to the invention.
Figure 4B:
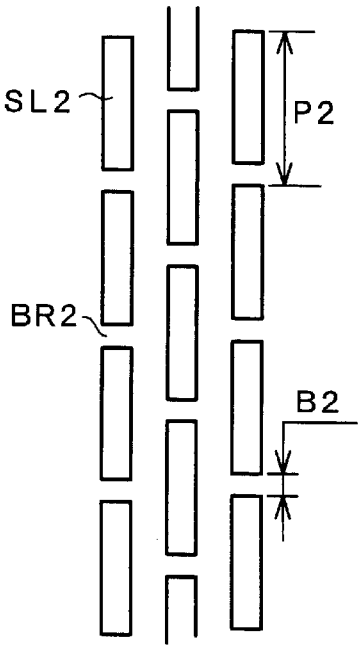

FIGS. 4A and 4B are plan views of essential portions similar to FIGS. 2A and 2B and FIGS. 3A and 3B, illustrating a third embodiment of the color cathode ray tube according to the invention. In this embodiment, the relationships among the connection-direction pitch P1 of the slots SL1 in the central portion (A), the connection-direction pitch P2 of the slots SL2 in the peripheral portion (B), the connected-slot space width B1 of each of the bridges BR1 which connect the slots SL1 in the central portion (A) and the connected-slot space width B2 of each of the bridges BR2 which connect the slots SL2 in the peripheral portion (B) are set to P1=P2 and B1>B2.

According to the constitution of this embodiment as well, it is possible to achieve effects and advantages similar to those of the first embodiment and provide a color cathode ray tube capable of displaying a high-quality picture. In addition, in the third embodiment, the long-length-direction pitch of the slots is equal between the central point and the peripheral portion, whereby the degradation of the vertical resolution of a display picture in the peripheral screen portion of the cathode ray tube is reduced. Accordingly, it is possible to provide a color cathode ray tube capable of displaying a high-definition picture.

In this embodiment as well, similarly to the cases of the first and second embodiments, even if the zone of the central portion (A) is enlarged to an approximately ⅔ width in the horizontal center of the apertured region 2, similar advantages can be achieved.

Specific numerical examples of this embodiment are as follows. Both the connection-direction pitch P1 of the slots SL1 in the central portion (A) and the connection-direction pitch P2 of the slots SL2 in the peripheral portion (B) are 0.84 mm. The other numerical examples are the same as those of the second embodiment.

Figure 5:
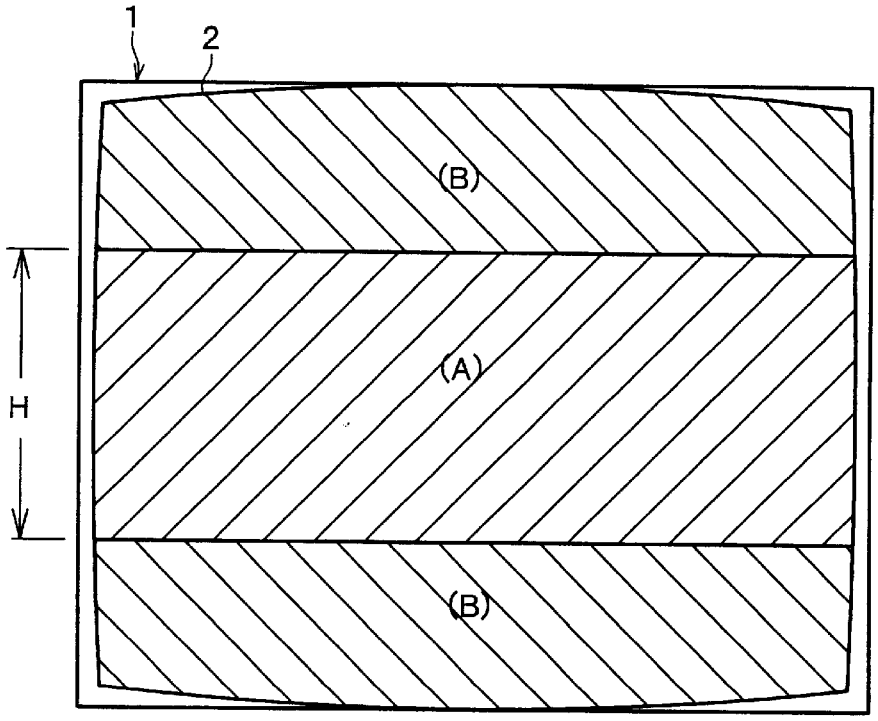
FIG. 5 is a plan view of a pressed mask, illustrating a fourth embodiment of the color cathode ray tube according to the invention.

FIG. 5 is a plan view of a pressed mask, illustrating a fourth embodiment of the color cathode ray tube according to the invention, and is a schematic explanatory view similar to FIG. 1.

Referring to FIG. 5, a zone which has an approximately ⅓ width H in the vertical center of the apertured region 2 of the pressed mask 1 is made the central portion (A), and each of the upper and lower sides of the central portion (A) is made the peripheral portion B. The approximately ⅓ zone which is made the central portion (A) is a region containing a portion where the radius of curvature of the pressed mask is the largest.

The connection-direction pitch of the slots formed in the central portion (A) and the peripheral portion (B) and the connected-slot space width of each of the bridges which connect the slots are formed to have a relationship similar to that of any of the first to third embodiments described previously in connection with FIGS. 2A to 4B.

According to the constitution of this embodiment as well, it is possible to achieve effects and advantages similar to those of each of the above-described embodiments and provide a color cathode ray tube capable of displaying a high-quality picture.

In addition, in this embodiment as well, the zone of the central portion (A) is not limited to the approximately ⅓ width in the vertical center of the apertured region 2 which width corresponds to the region containing the portion where the radius of curvature of the pressed mask is the largest, and even if the zone of the central portion (A) is defined as an approximately ⅔ width in the vertical center of the apertured region 2 which width corresponds to a region which contains the approximately ⅓ width and has a comparatively large radius of curvature, similar advantages can be achieved.

Figure 6:
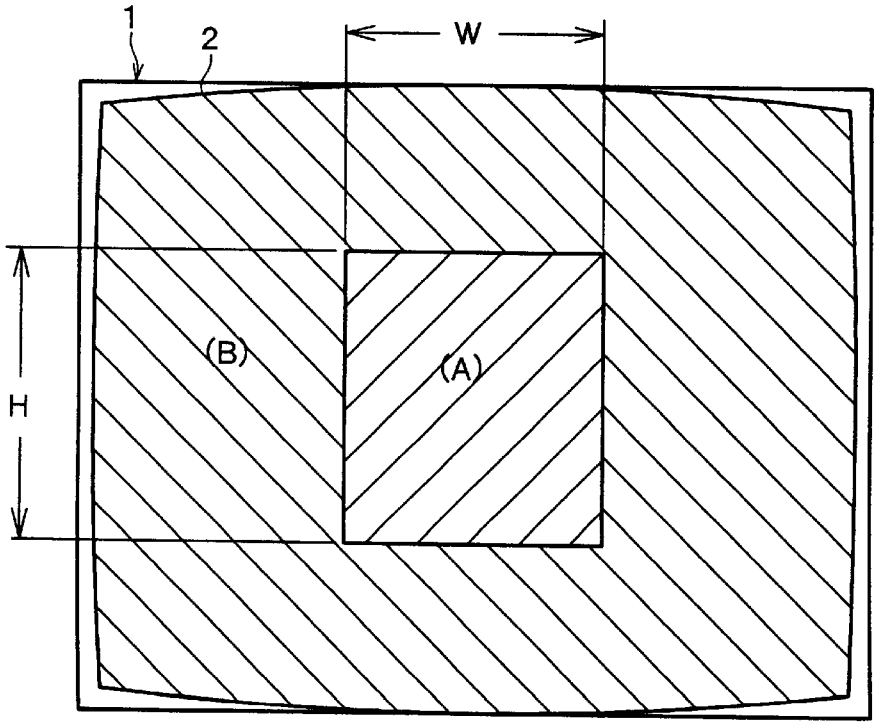
FIG. 6 is a plan view of a pressed mask, illustrating a fifth embodiment of the color cathode ray tube according to the invention.

FIG. 6 is a plan view of a pressed mask, illustrating a fifth embodiment of the color cathode ray tube according to the invention, and is a schematic explanatory view similar to FIG. 5.

In this embodiment, a zone which has an approximately ⅓ width W in the horizontal center of the apertured region 2 of the pressed mask 1 and an approximately ⅓ width H in the vertical center of the apertured region 2 of the pressed mask 1 is made the central portion (A), and the surrounding portion of the central portion (A) is made the peripheral portion B. The zone which is of approximately ⅓ width in each of the horizontal and vertical directions and is made the central portion (A) is a region containing a portion where the radius of curvature of the pressed mask is the largest.

The connection-direction pitch of the slots formed in the central portion (A) and the peripheral portion (B) and the connected-slot space width of each of the bridges which connect the slots are formed to have a relationship similar to that of any of the first to third embodiments described previously in connection with FIGS. 2A to 4B.

According to this embodiment as well, it is possible to achieve effects and advantages similar to those of each of the above-described embodiments and provide a color cathode ray tube capable of displaying a high-quality picture.

In addition, in this embodiment as well, the zone of the central portion (A) is not limited to the zone (W×H) surrounded by the approximately ⅓ widths in the horizontal and vertical centers of the apertured region 2 which widths correspond to the region containing the portion where the radius of curvature of the pressed mask is the largest, and even if the zone of the central portion (A) is defined as a region surrounded by approximately ⅔ widths in either or both of the horizontal and vertical centers of the apertured region 2 which widths correspond to a region which contains these approximately ⅓ widths and has a comparatively large radius of curvature, similar advantages can be achieved. Moreover, even if the zone of the central portion (A) is given a circular, elliptical or oval shape which has an approximately ⅓–⅔ diameter in each of the horizontal and vertical directions of the apertured region 2, similar advantages can be achieved.

Figure 7:
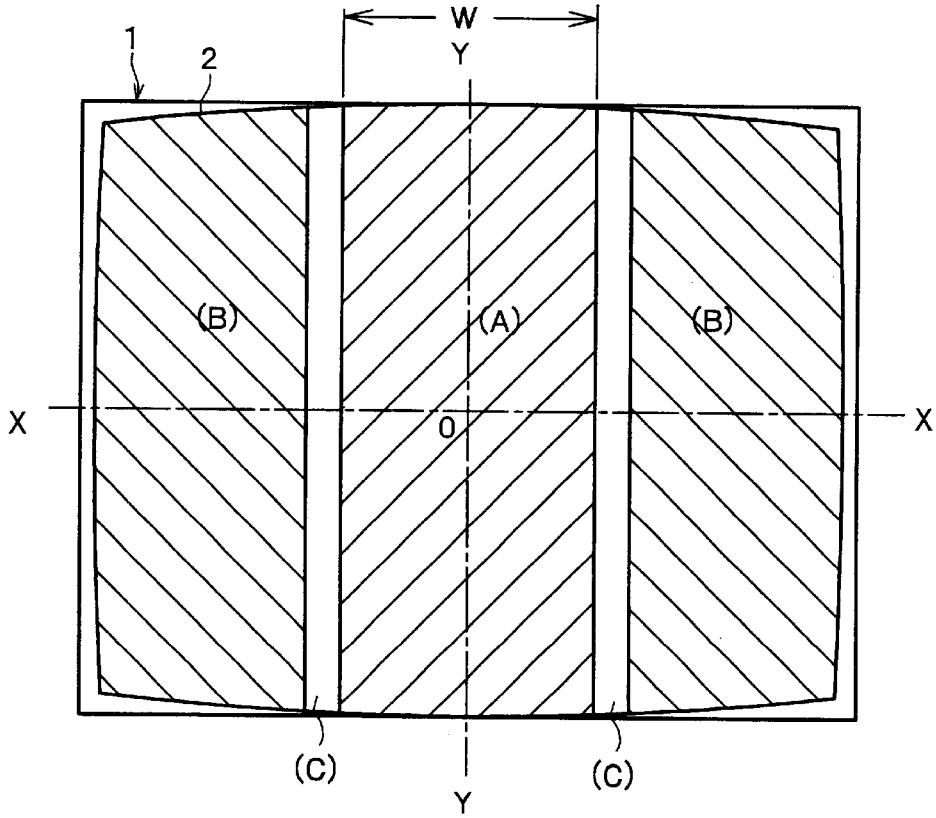
FIG. 7 is a plan view of a pressed mask, illustrating a sixth embodiment of the color cathode ray tube according to the invention.

FIG. 7 is a plan view of a pressed mask, illustrating a sixth embodiment of the color cathode ray tube according to the invention, and is a schematic explanatory view similar to FIGS. 5 and 6.

In this embodiment, a zone which has an approximately ⅓ width W in the horizontal center of the apertured region 2 of the pressed mask 1 is made the central portion (A), and each of the right and left sides of the central portion (A) is made the peripheral portion (B) with an intermediate portion (C) interposed between each of the right and left sides and the peripheral portion (B). The approximately ⅓ zone which is made the central portion (A) is a region which contains a portion where the radius of curvature of the pressed mask is the largest.

The connection-direction pitch of the slots formed in the central portion (A) and the peripheral portion (B) and the connected-slot space width of each of the bridges which connect the slots are formed to have a relationship similar to that of any of the first to third embodiments described previously in connection with FIGS. 2A to 4B. In addition, the long-length-direction pitch of slots formed in the intermediate portion (C) is defined as the pitch which is an intermediate value of the central portion (A) and the peripheral portion (B), the connection-direction width of each bridge that connects slots in the long-length direction is defined as the width which is an intermediate value of the central portion (A) and the peripheral portion (B).

According to this embodiment, the area of the bridges BR1 per unit area in the central portion (A) becomes larger than that in the peripheral portion (B). Accordingly, the mechanical strength of the central portion (A) of the pressed mask can be made large. In addition, the mechanical strength from the central portion (A) to the peripheral portion (B) can be gradually varied owing to the interposition of the intermediate portions (C), whereby even if the radius of curvature becomes large, the curved shape of the pressed mask can be retained without unreasonableness.

Accordingly, similarly to the case of each of the above-described embodiments, the deformation of the pressed mask is restrained, whereby the color deviation and color irregularity of the color cathode ray tube can be restrained. In addition, the opening rate of the slots SL2 is higher in the peripheral portion (B) than in the central portion (A), whereby the brightness of the peripheral portion (B) can be improved to be far more uniform. Even if a tint panel having a low optical transmissivity is employed, the low optical transmissivity of the peripheral portion of the tint panel can be corrected to enable a high-luminance picture to be displayed on the entire screen, whereby it is possible to provide a color cathode ray tube capable of displaying a high-quality picture.

In addition, in this embodiment as well, the zone of the central portion (A) is not limited to the approximately ⅓ width in the horizontal center of the apertured region 2 which width corresponds to the region containing the portion where the radius of curvature of the pressed mask is the largest, and even if the zone of the central portion (A) is defined as an approximately ⅔ width and a small intermediate portion (C) is interposed between the central portion (A) and the peripheral portion (B), similar advantages can be achieved. The width of this intermediate portion (C) may be appropriately set according to the size of the apertured region 2, i.e., the size of the pressed mask.

Figure 8:
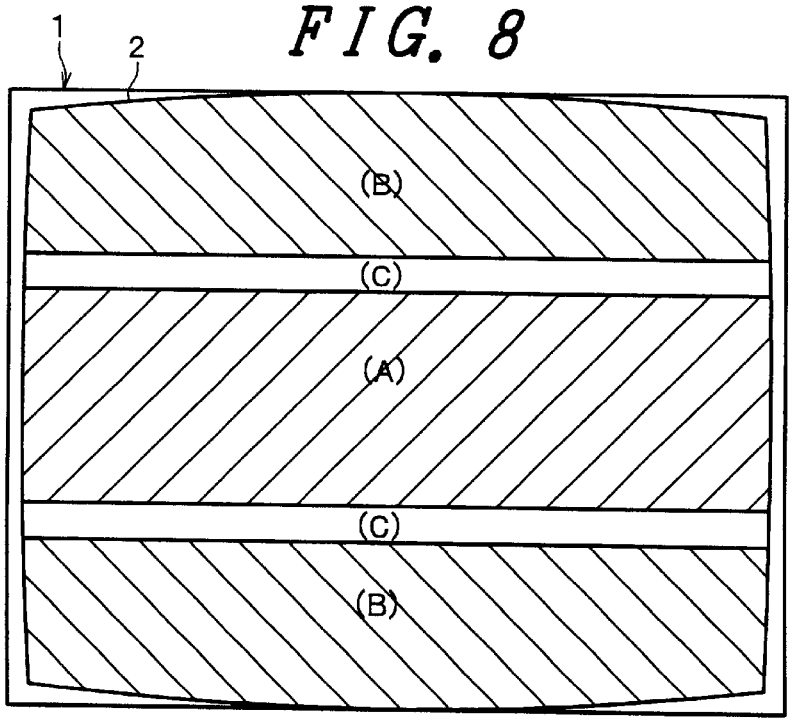
FIG. 8 is a plan view of a pressed mask, illustrating a seventh embodiment of the color cathode ray tube according to the invention.

FIG. 8 is a plan view of a pressed mask, illustrating a seventh embodiment of the color cathode ray tube according to the invention, and is a schematic explanatory view similar to FIGS. 5 to 7.

In this embodiment, the intermediate portion (C) is interposed between the central portion (A) and the peripheral portion (B) in the fourth embodiment of the invention described previously with reference to FIG. 5, and the advantage of the seventh embodiment is equivalent to a combination of that of the fourth embodiment and that of the intermediate portion (C) described above with reference to FIG. 7. Similarly to the case of the sixth embodiment, the width of this intermediate portion (C) may be appropriately set according to the size of the apertured region 2, i.e., the size of the pressed mask.

According to this embodiment as well, it is possible to achieve effects and advantages similar to those of the sixth embodiment and provide a color cathode ray tube capable of displaying a high-quality picture.

Figure 9:
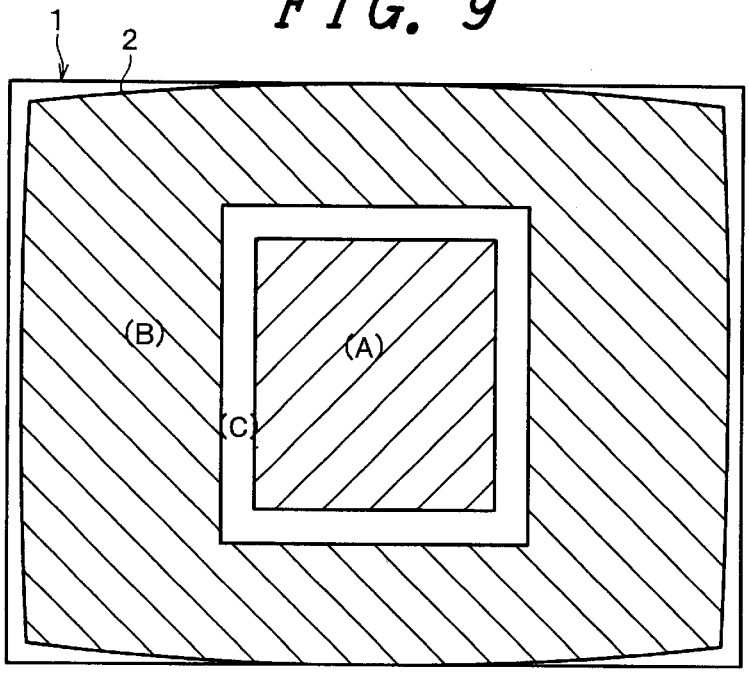
FIG. 9 is a plan view of a pressed mask, illustrating an eighth embodiment of the color cathode ray tube according to the invention.

FIG. 9 is a plan view of a pressed mask, illustrating an eighth embodiment of the color cathode ray tube according to the invention, and is a schematic explanatory view similar to FIGS. 5 to 8.

In this embodiment, the intermediate portion (C) is interposed between the central portion (A) and the peripheral portion (B) in the fifth embodiment of the invention described previously with reference to FIG. 6, and the advantage of the eighth embodiment is equivalent to a combination of that of the fifth embodiment and those of the intermediate portions (C) described above with reference to FIGS. 7 and 8. Similarly to the case of each of the sixth and seventh embodiments, the width of this intermediate portion (C) may be appropriately set according to the size of the apertured region 2, i.e., the size of the pressed mask.

According to this embodiment as well, it is possible to achieve effects and advantages similar to those of the sixth and seventh embodiments and provide a color cathode ray tube capable of displaying a high-quality picture.

The details of the pressed mask used in the color cathode ray tube according to the invention and the entire constitution of the color cathode ray tube using this pressed mask will be described below.

Figure 10:
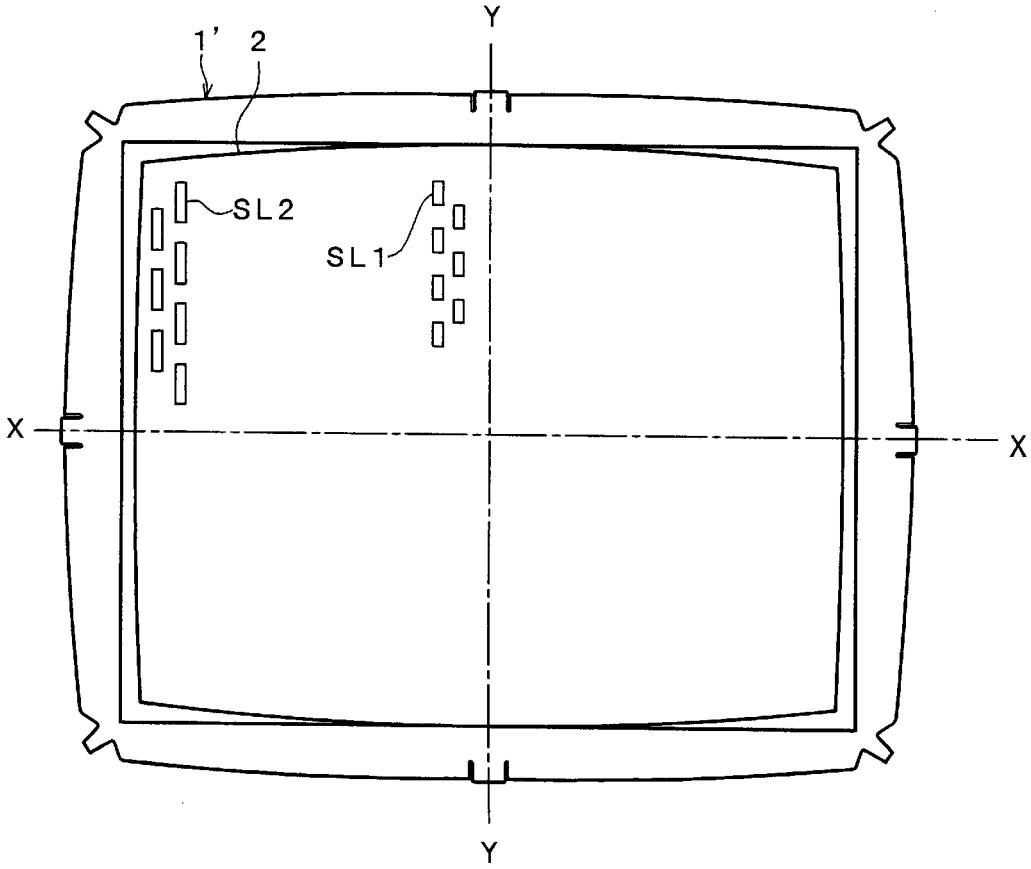
FIG. 10 is a plan view illustrating the shape of an intermediate member formed before being shaped into the pressed mask.

FIG. 10 is a plan view illustrating the shape of an intermediate member formed before being shaped into the pressed mask. This intermediate member 1' has the apertured region 2 which is made of a thin plate of iron-containing metal and has a large number of slots SL (SL1 and SL2) formed therein by etching treatment. The slots SL1 in the central portion and the slots SL2 in the peripheral portion are disposed in the shape described previously in connection with any of the above-mentioned embodiments.

Figure 11B:
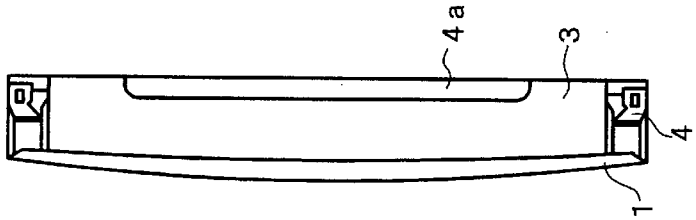
FIGS. 11A, 11B and 11C are explanatory views of a pressed mask assembly in which the intermediate member shown in FIG. 10 is press-shaped into a curved shape and is fixed to a mask frame.
Figure 11A:
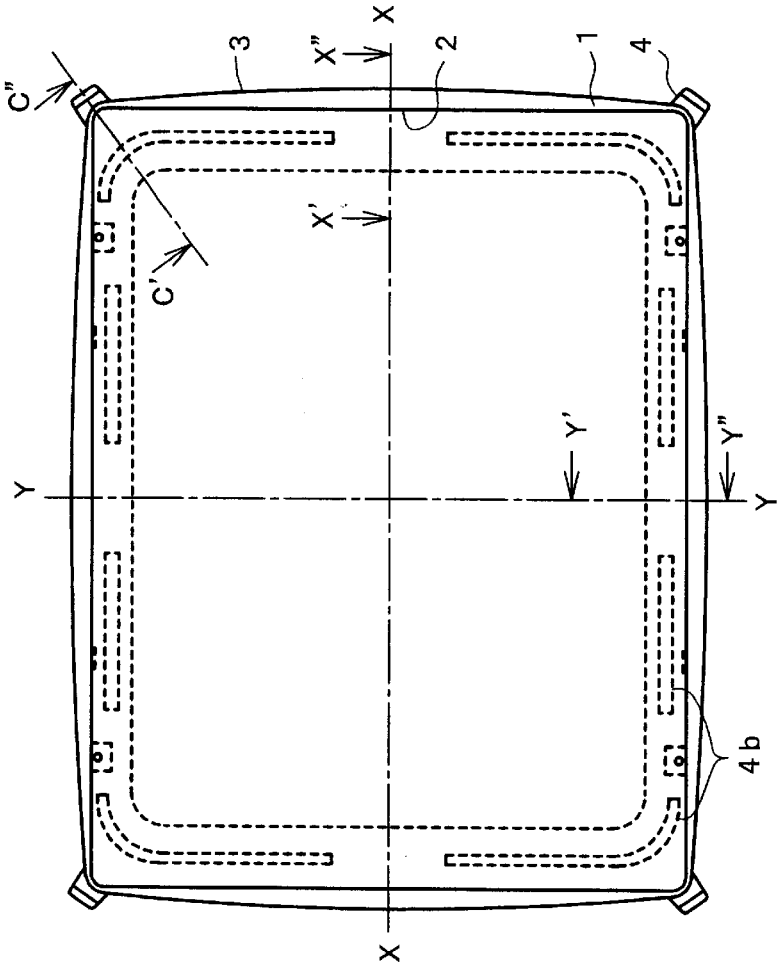
Figure 11C:
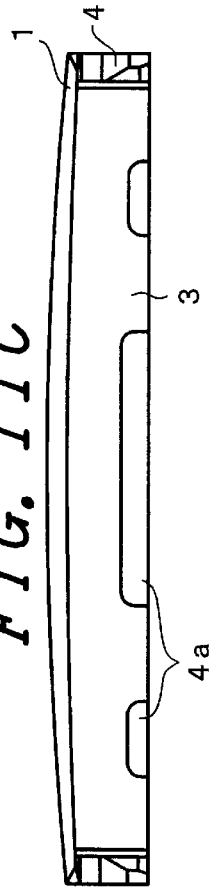

FIGS. 11A, 11B and 11C are explanatory views of a pressed mask assembly in which the intermediate member shown in FIG. 10 is press-shaped into a curved shape and is fixed to a mask frame. FIG. 11A is a plan view seen from a side which faces a phosphor screen, FIG. 11B is a side view seen from a short side of FIG. 11A, and FIG. 11C is a side view seen from a long side of FIG. 11A.

The pressed mask 1 is formed into a curved shape by press forming so that the apertured region 2 is made convex toward the phosphor screen, and the skirt portion of the pressed mask 1 is shaped by being bent in the direction parallel to the tube axis of the color cathode ray tube.

The bent skirt portion is welded to the inner wall of a masked frame 3 which is a frame-like member, and suspension springs 4 for fitting the pressed mask assembly into the panel of the color cathode ray tube are fixedly welded to the outer wall of the masked frame 3 in the corner portions thereof, respectively. Incidentally, the masked frame 3 is appropriately given recessed grooves 4*a* and 4*b* for reinforcing the mechanical strength of the masked frame 3. Incidentally, the reinforcing means for the mechanical strength is not limited to those shown in FIGS. 11A, 11B and 11C, and known reinforcing means can be applied.

Figure 12A:
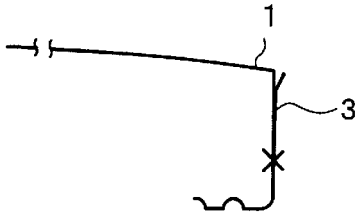
FIGS. 12A and 12B are explanatory views of the structure of an essential portion of the pressed mask assembly shown in FIGS. 11A, 11B and 11C.
Figure 12B:
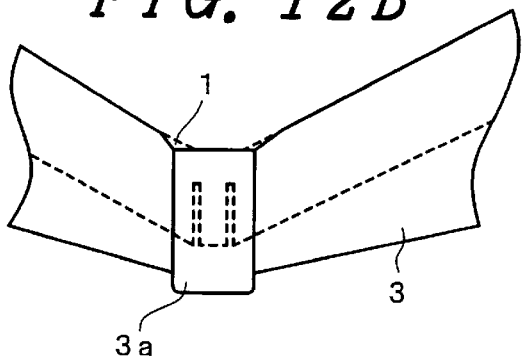

FIGS. 12A and 12B are explanatory views of the structure of an essential portion of the pressed mask assembly shown in FIGS. 11A, 11B and 11C. FIG. 12A is a cross-sectional view taken along line C'–C", X'–X" or Y'–Y" of FIG. 11A, and FIG. 12B is a partial view illustrating a combination structure of the pressed mask and the mask frame in one of the corner portions of FIG. 11A.

In FIG. 12A, the pressed mask 1 is fitted in the inner wall of the masked frame 3 and is welded at a welding point indicated by x in FIG. 12A. Such a welding point is provided at plural locations around the masked frame 3, and the number and position of welding points are set according to the size of the pressed mask assembly, the radius of curvature of the curved shape and other conditions.

Each of the corner portions of the pressed mask assembly has a wall surface 3*a* as shown in FIG. 12B, and the suspension spring 4 (refer to FIGS. 11A, 11B and 11C) is welded to this wall surfaces 3*a*.

The pressed mask assembly assembled in this manner is installed close to the phosphor screen applied to the inner panel surface of the color cathode ray tube. The installation of the pressed mask assembly in the panel is performed by engaging the suspension springs 4 shown in FIGS. 11A, 11B and 11C with stud pins which are protrudingly disposed on the inner side walls of the panel.

Figure 13:
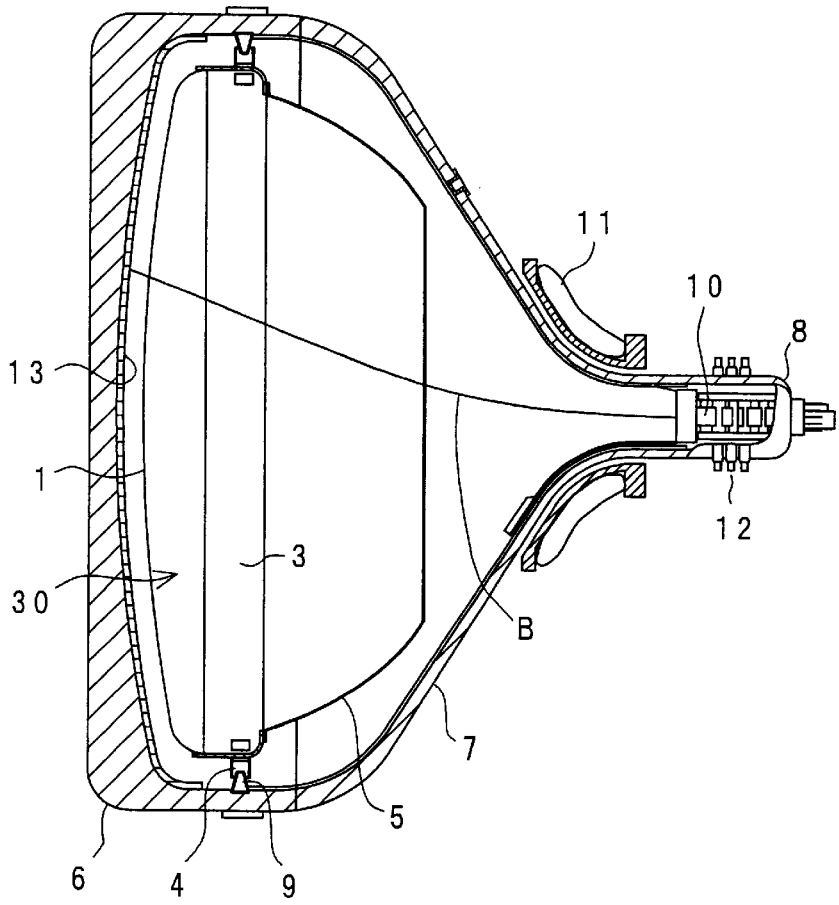
FIG. 13 is a cross-sectional view schematically illustrating an example of the whole construction of the color cathode ray tube according to the invention.

FIG. 13 is a cross-sectional view schematically illustrating an example of the whole construction of the color cathode ray tube according to the invention. This color cathode ray tube has an evacuated envelope which is comprised of a panel 6 made of tint glass having an approximately rectangular display surface, a neck 8 which accommodates an electron gun 10 for emitting three electron beams B, and an approximately funnel-like funnel 7 which connects the panel 6 and the neck 8.

The standard value of the optical transmissivity of the panel 6 made of the above-described tint glass is 57%, which is a value relative to glass plate thickness 10.16 mm at wavelength 546 nm. This tint panel is defined within the range of ±2% of the standard value. If a panel having an optical transmissivity of approximately 60% or less is used, a high-contrast picture can be obtained in the color cathode ray tube. A dark tint panel suited for displaying a far higher contrast picture than the tint panel does has an optical transmissivity whose standard value is 46%, and is defined within the range of ±2% of this standard value.

The outer surface, i.e., the display surface, of the panel 6 which constitutes this evacuated envelope is of a so-called flat-face type in which the outer surface is a flat surface or a surface which has a very large radius of curvature and is curved extremely slightly.

Figure 14:
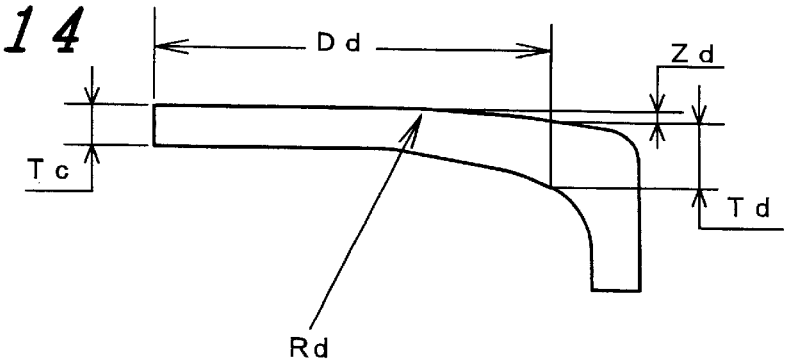
FIG. 14 is a partial cross-sectional view illustrating the detailed shape of a panel.

FIG. 14 is a partial cross-sectional view illustrating the detailed shape of the panel that is formed in a diagonal direction. If the outer surface of the curved panel is a non-spherical surface, the outer panel surface has different radii of curvature at arbitrary positions. Therefore, the curvature of this outer panel surface can be defined as follows when expressed by the equivalent radius of curvature Rd (mm):

$$Rd=(Zd^2+Dd^2)/2Zd,$$

where Dd denotes the distance (mm) in the direction perpendicular to the tube axis from the center of the outer panel surface to an end portion of the effective region of the phosphor screen, and Zd denotes the fall amount (mm) in the tube axis direction from the center of the outer panel surface at the end portion of the effective region of the phosphor screen. Incidentally, even if the outer panel surface is replaced with the inner panel surface or the shadow mask (pressed mask), the curvature can be similarly defined. In addition, even if the diagonal direction is replaced with a long-axis direction or a short-axis direction, the curvature can be similarly defined.

Even if the outer panel surfaces of cathode ray tubes have the same radius of curvature, the cathode ray tubes differ in the feeling of flatness according to whether the screen size of each of the cathode ray tubes is large or small. Therefore, to evaluate this flatness feeling, the outer-surface radius of curvature Ro (mm) and the inner-surface radius of curvature Ri (mm) of a panel which is standardized irrespective of screen sizes are defined as follows:

$$Ro=42.5V+45.0,$$

$$Ri=40.0V+40.0,$$

where V denotes the effective diameter (inch) of the screen taken in the diagonal direction. The extent of flatness of the panel can be expressed by a multiple of the outer-surface radius of curvature Ro or the inner-surface radius of curvature Ri (mm) of the standardized panel. Incidentally, the term "inch" which represents the effective diameter is customarily used for expressing the screen size of a cathode ray tube, and is a numerical value which is generally used like "—inch type cathode ray tube".

In the invention, by making the equivalent radius of curvature of the outer panel surface 10 Ro or more, the screen is made to look approximately flat. If the equivalent radius of curvature is made 20 Ro or more, the screen looks almost completely flat.

In the invention, since the pressed mask 1 which has the apertured region curved in a convex shape is used as the shadow mask, the inner surface of the panel 6 cannot be made a flat-face type surface similar to the above-described outer panel surface, and is curved with a radius of curvature considerably larger than that of the outer panel surface. The inner surface has a curved surface so that a plate thickness Td in the tube axis direction at each effective screen corner (diagonal end) of the panel 6 is made considerably thicker than a plate thickness Tc in the tube axis direction at the center of the panel 6, and the inner surface is made concave toward the outer surface.

If a reduction in brightness irregularity and an improvement in picture contrast are to be made compatible with each other in the center and the periphery of the screen of the cathode ray tube, it is desirable that the plate thickness difference Td−Tc between each effective screen corner (diagonal end) of the panel 6 and the center thereof (a diagonal wedge amount Wd) is made as small as possible and a glass material having as low an optical transmissivity as possible is used.

In the invention, it is possible to apply a tint panel having an optical transmissivity of 60% or less by setting the Wd/Tc ratio of the diagonal wedge amount Wd to the panel-center plate thickness Tc to 0.8 or less. In addition, by setting the Wd/Tc ratio to 0.7 or less, it is possible to apply a dark tint panel having an optical transmissivity of 50% or less. The diagonal wedge amount Wd is preferably 12 mm or less if the tint panel is used, and preferably 10 mm or less if the dark tint panel is used. In either case, the equivalent radius of curvature in the inner surface of the panel 6 is preferably 6,000 mm or more in the diagonal direction.

It is desirable that the curved surface of the apertured region 2 of the pressed mask 1 be formed to follow the inner surface of the panel 6 as completely as possible so that the electron beams B can be made to easily land on a phosphor screen 13.

In the invention, the equivalent radius of curvature of the pressed mask 1 is made 4,000 mm or more in the diagonal direction of the apertured region 2. This equivalent radius of curvature is a considerably large radius of curvature compared to the pressed masks in the related art round-face types of color cathode ray tubes, and the diagonal direction is the direction in which the mechanical strength of the central portion of the pressed mask lowers. However, by adopting the pressed mask of any of the above-described embodiments according to the invention, it is possible to take countermeasures against the problem of mechanical strength.

The phosphor screen 13 to which phosphor picture elements for three colors are applied in a predetermined arrangement is formed on the inner surface of the panel 6.

A pressed mask assembly 30 in which the pressed mask 1 is welded to the masked frame 3 is secured in such a manner that the suspension springs 4 welded to the corner portions of the pressed mask assembly 30 are respectively engaged with stud pins 9 which are protrudingly disposed on the inner wall surface of the panel 6. In addition, a magnetic shield 5 for shielding the electron beams B from an external magnetic field such as terrestrial magnetism is secured to the electron-gun side of the pressed mask assembly 30.

Fitted on the neck 8 side of the funnel 7 is a deflection yoke 11 for deflecting the three electron beams B emitted from the electron gun 10 in the horizontal direction (the X—X direction or the lateral direction) and in the perpendicular direction (the Y—Y direction or the vertical direction). Fitted on the outer circumference of the neck 8 is an auxiliary magnetic device 12 for acting on the space, mutual position and traveling direction of the electron beams B to correct color purity and beam convergence deviation (mis-convergence).

The electron gun 10 is supplied with a picture signal from an external circuit which is not shown. Three beams are modulated with this picture signal, and the modulated electron beams B are emitted toward the phosphor screen 13 and are deflected midway by a horizontal magnetic field and a perpendicular magnetic field generated by the deflection yoke 11, thereby reproducing a two-dimensional picture on the phosphor screen 13.

The color cathode ray tube according to the invention is provided with the pressed mask described above in connection with any of the above-mentioned embodiments, whereby the deformation of the pressed mask due to the application of external shock or the influence of operating temperature does not easily occur, and therefore, the color cathode ray tube can display a high-quality picture in which the occurrence of color deviation and color irregularity is remarkably reduced.

The invention is not limited to the embodiments described heretofore and various modifications can be made without departing from the technical idea of the invention as set forth in appended claims.

As has been described heretofore, according to a typical constitution of the invention, the deformation of a shadow mask which is a color selection electrode is restrained and the electron beam transmissivity in the peripheral portion of the apertured region of the shadow mask can be improved, whereby a tint panel and a pressed mask can be combined even in a large-sized or very-large-sized flat-face type of color cathode ray tube and a high-quality color cathode ray tube free of color deviation or color irregularity can be realized at low cost.

What is claimed is:

1. A color cathode ray tube comprising:

an evacuated envelope including a panel having an approximately rectangular shape formed by long sides and short sides and having an inner surface curved with an equivalent radius of curvature smaller than that of an outer surface as well as a phosphor screen formed on the inner surface, a neck accommodating an electron gun, and a funnel connecting the panel and the neck; and a pressed mask having an apertured region disposed close to the inner surface of the panel and having a curvature curved to become convex toward the phosphor screen and multiple slots formed to be connected by bridges in their long-length directions, wherein letting Rd (mm) be the equivalent radius of curvature of the outer surface of the panel in a diagonal direction thereof in the effective region of the phosphor screen and letting V (inch) be an effective diameter of the phosphor screen in a diagonal direction thereof, $$Rd \geqq 10(42.5V+45.0),$$

the optical transmissivity of the panel being 60% or less, the opening rate per unit area of the slots in the pressed mask being larger at an end of the apertured region in the diagonal direction than the center of the apertured region, and where B1>B2, letting B1 be the connected-slot space width of each of the bridges in the center of the apertured region of the pressed mask and letting B2 be the connected-slot space width of each of the bridges at the end of the apertured region in the diagonal direction.

2. A color cathode ray tube according to claim 1, wherein letting P1 be the connection-direction pitch of slots in the center of the apertured region of the pressed mask and letting P2 be the connection-direction pitch of slots at the end of the apertured region in the diagonal direction, $$P1<P2.$$

3. A color cathode ray tube according to claim 1, wherein the optical transmissivity of the panel is 50% or less.

4. A color cathode ray tube comprising:

an evacuated envelope including a panel having an approximately rectangular shape formed by long sides and short sides and having an inner surface curved with an equivalent radius of curvature smaller than that of an outer surface as well as a phosphor screen formed on the inner surface, a neck accommodating an electron gun, and a funnel connecting the panel and the neck; and a pressed mask having an apertured region disposed close to the inner surface of the panel and having a curvature curved to become convex toward the phosphor screen and multiple slots formed to be connected by bridges in their long-length directions, wherein letting Rd (mm) be the equivalent radius of curvature of the outer surface of the panel in a diagonal direction thereof in the effective region of the phosphor screen and letting V (inch) be an effective diameter of the phosphor screen in a diagonal direction thereof, $$Rd \geqq 10(42.5V+45.0),$$

letting Td be the thickness in a tube-axis direction of the end of the panel in the diagonal direction in the effective region of the phosphor screen and letting Tc be the thickness in the tube-axis direction of the center of the panel, $$(Td-Tc)/Tc \leqq 0.8,$$

the ratio of the bridges per unit area in the pressed mask being larger in the center of the apertured region than at the end of the apertured region in the diagonal direction.

5. A color cathode ray tube according to claim 4, wherein letting P1 be the connection-direction pitch of slots in the center of the apertured region of the pressed mask and letting P2 be the connection-direction pitch of slots at the end of the apertured region in the diagonal direction, $$P1<P2.$$

6. A color cathode ray tube according to claim 4, wherein letting P1 be the connection-direction pitch of the slots in the center of the apertured region of the pressed mask, letting P2 be the connection-direction pitch of the slots at the end of the apertured region in the diagonal direction, letting B1 be the connected-slot space width of each of bridges in the center of the apertured region, and letting B2 be the connected-slot space width of each of bridges at the end of the apertured region in the diagonal direction, $$P1<P2 \text{ and } B1>B2.$$

7. A color cathode ray tube according to claim 4, wherein letting B1 be the connected-slot space width of each of bridges in the center of the apertured region of the pressed mask and letting B2 be the connected-slot space width of each of bridges at the end of the apertured region in the diagonal direction, $$B1>B2.$$

8. A color cathode ray tube according to claim 4, wherein $Td-Tc \leqq 12$ mm.

9. A color cathode ray tube according to claim 4, wherein the optical transmissivity of the panel is 60% or less.

10. A color cathode ray tube according to claim 4, wherein $(Td-Tc)/Tc \leqq 0.7$.

11. A color cathode ray tube according to claim 10, wherein $Td-Tc \leqq 10$ mm.

12. A color cathode ray tube according to claim 10, wherein the optical transmissivity of the panel is 50% or less.

13. A color cathode ray tube according to claim 4, wherein an effective diameter of the phosphor screen in the diagonal direction thereof is 76 cm or more.

14. A color cathode ray tube comprising:

an evacuated envelope including a panel having an approximately rectangular shape formed by long sides and short sides and having an inner surface curved with an equivalent radius of curvature smaller than that of an outer surface as well as a phosphor screen formed on the inner surface, a neck accommodating an electron gun, and a funnel connecting the panel and the neck; and a pressed mask having an apertured region disposed close to the inner surface of the panel and having a curvature curved to become convex toward the phosphor screen and multiple slots formed to be connected by bridges in their long-length directions, wherein letting Rd (mm) be the equivalent radius of curvature of the outer surface of the panel in a diagonal direction thereof in the effective region of the phosphor screen and letting V (inch) be an effective diameter of the phosphor screen in a diagonal direction thereof, $$Rd \geqq 10(42.5V+45.0),$$

the opening rate per unit area of the slots in the pressed mask being larger at an end of the apertured region in the diagonal direction than in the center of the apertured region, the ratio of the bridges per unit area in the pressed mask being larger in the center of the apertured region than at the end of the apertured region in the diagonal direction, and where B1>B2, letting B1 be the connected-slot space width of each of the bridges in the center of the apertured region of the pressed mask and letting B2 be the connected-slot space width of each of the bridges at the end of the apertured region in the diagonal direction.

15. A color cathode ray tube according to claim 14, wherein letting P1 be the connection-direction pitch of slots in the center of the apertured region of the pressed mask and letting P2 be the connection-direction pitch of slots at the end of the apertured region in the diagonal direction, $$P1<P2.$$

16. A color cathode ray tubing comprising:

an evacuated envelope including a panel having an approximately rectangular shape formed by long sides and having an inner surface curved with an equivalent radius of curvature small than that of an outer surface as well as a phosphor screen formed on the inner surface, a neck accommodating an electron gun, and a funnel connecting the panel and the neck; and a pressed mask having an apertured region disposed close to the inner surface of the panel and having a curvature curved to become convex toward the phosphor screen and multiple slots formed to be connected by bridges in their long-length directions, wherein letting Rd (mm) be the equivalent radius of curvature of the outer surface of the panel in a diagonal direction thereof in the effective region of the phosphor screen and letting V (inch) be an effective diameter of the phosphor screen in a diagonal direction thereof, $$Rd \geqq 10(42.5V+45.0),$$

the opening rate per unit area of the slots in the pressed mask being larger at an end of the apertured region in the diagonal direction than in the center of the apertured region, the ratio of the bridges per unit area in the pressed mask being larger in the center of the apertured region than at the end of the apertured region in the diagonal direction, wherein an effective diameter of the phosphor screen in the diagonal direction thereof is 76 cm or more.

17. A color cathode ray tube according to claim 2, wherein the connection-direction pitch of the slots is gradually increased from the center of the apertured region toward the end of the apertured region in the diagonal direction.

18. A color cathode ray tube according to claim 1, wherein the connected-slot space width of each of the bridges is gradually decreased from the center of the apertured region toward the end of the apertured region in the diagonal direction.

19. A color cathode ray tube according to claim 15, wherein the connection-direction pitch of the slots is gradually increased from the center of the apertured region toward the end of the apertured region in the diagonal direction.

20. A color cathode ray tube according to claim 14, wherein the connected-slot space width of each of the bridges is gradually decreased from the center of the apertured region toward the end of the apertured region in the diagonal direction.

* * * * *